US006179999B1

(12) United States Patent
Sherman et al.

(10) Patent No.: US 6,179,999 B1
(45) **Date of Patent: *Jan. 30, 2001**

(54) METHOD OF REMOVING CONTAMINANTS FROM USED OIL

(75) Inventors: Jeffrey H. Sherman, Dallas, TX (US); Richard T. Taylor, Oxford, OH (US)

(73) Assignee: Miami University, Oxford, OH (US)

( * ) Notice: Under 35 U.S.C. 154(b), the term of this patent shall be extended for 0 days.

This patent is subject to a terminal disclaimer.

(21) Appl. No.: 09/418,448

(22) Filed: Oct. 15, 1999

Related U.S. Application Data

(63) Continuation-in-part of application No. 09/250,741, filed on Feb. 16, 1999, now Pat. No. 6,007,701.

(51) Int. Cl.[7] ..... C10M 75/00

(52) U.S. Cl. ..... 208/183; 208/139; 208/181; 208/265

(58) Field of Search ..... 208/179, 181, 208/183

(56) References Cited

U.S. PATENT DOCUMENTS 5,814,207 9/1998 Kenton ..... 208/184

*Primary Examiner*—Helane Myers
(74) *Attorney, Agent, or Firm*—Michael A. O'Neil

(57) ABSTRACT

In a method of removing acidic compounds, color, and polynuclear aromatic hydrocarbons, and for removing or converting hydrocarbons containing heteroatoms from used oil distillate, phase transfer catalysts are employed to facilitate the transfer of inorganic or organic bases to the substrate of the oil distillate. An inorganic or organic base, a phase transfer catalyst selected from the group including quaternary ammonium salts, polyol ethers and crown ethers, and used oil distillate are mixed and heated. Thereafter, contaminants are removed from the used oil distillate through distillation.

3 Claims, 1 Drawing Sheet

METHOD OF REMOVING CONTAMINANTS FROM USED OIL

CROSS-REFERENCE TO RELATED APPLICATION

This is a continuation-in-part application under 37 C.F.R. §1.53 of application Ser. No. 09/250,741 now U.S. Pat. No. 6,607,701 filed Feb. 16, 1999, currently pending.

TECHNICAL FIELD

This invention relates generally to the removal of contaminants from used oil, and more particularly to a method of removing acidic compounds, color, and polynuclear aromatic hydrocarbons, and removing or converting heteroatoms from used oil distillates.

BACKGROUND AND SUMMARY OF THE INVENTION

It has long been recognized that used motor oils can be recycled by removing the contaminants which accumulate therein during operation of the motor vehicles in which the motor oils are utilized. Recently, the American Society for Testing and Materials (ASTM) has promulgated its Designation: D 6074-99 wherein the ASTM Committee D-2 on Petroleum Products and Lubricants has promulgated standards for re-refined base oils. Included in Designation: D 6074-99 are numerous attributes of base oils, including attributes relating to physical properties, compositional properties, chemical properties, and toxicological properties.

Prior to World War II, used motor oil was re-refined using a process involving the addition of sulphuric acid in order to separate the contaminants from the useful hydrocarbon components of used motor oil. Re-refining processes of the type involving the addition of sulphuric acid to used motor oil are no longer used because they result in the generation of large amounts of highly toxic acidic sludge which cannot be disposed of economically. Additionally, such re-refining techniques do not fulfill the requirements of ASTM Designation: D 6074-99.

More recently, used motor oils have been re-refined utilizing a process known as hydrotreating. In accordance with the hydrotreating process, used motor oils are treated with hydrogen under high pressure. Hydrotreating is successful in removing olefins and alkanes from used motor oils and can also be used in removing heteroatoms therefrom. However, the hydrotreating process is expensive to the point that it cannot be operated profitably.

U.S. Pat. No. 5,814,207 discloses a used motor oil re-refining method and apparatus wherein up to four evaporators are connected one to another in a series. It will therefore be understood that the apparatus of the '207 patent is expensive to install and use. More importantly, the used motor oil re-refining method of the '207 patent cannot meet the requirements of ASTM Designation: D 6074-99 because it cannot remove heteroatoms and because it cannot meet the toxicological requirements of the designation.

Co-pending U.S. application Ser. No. 09/250,741 filed Feb. 16, 1999, and assigned to the assignee hereof discloses a re-refining process wherein used motor oil is treated with an organic or inorganic base in the presence of a phase transfer catalyst. The process is successful in removing acidic compounds, color, and polynuclear aromatic hydrocarbons and in removing or substituting heteroatoms from used motor oil distillates. Co-pending application Ser. No. 09/265,903 filed Mar. 24, 1999, and also assigned to the assignee hereof discloses a re-refining process wherein used motor oil is contacted with a highly polar organic solvent, such as N, N-dimethylformamide. The process is successful in removing polynuclear aromatic hydrocarbons, sulphur-containing substances, nitrogen-containing substances, and other contaminants from used motor oil and distillates.

The present invention comprises a process for re-refining used motor oils which is an improvement over the process of application Ser. No. 09/250,741. The process of the invention is unique in that it is the only known process which safely and economically fulfills all of the requirements of ASTM Designation: D 6074-99.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
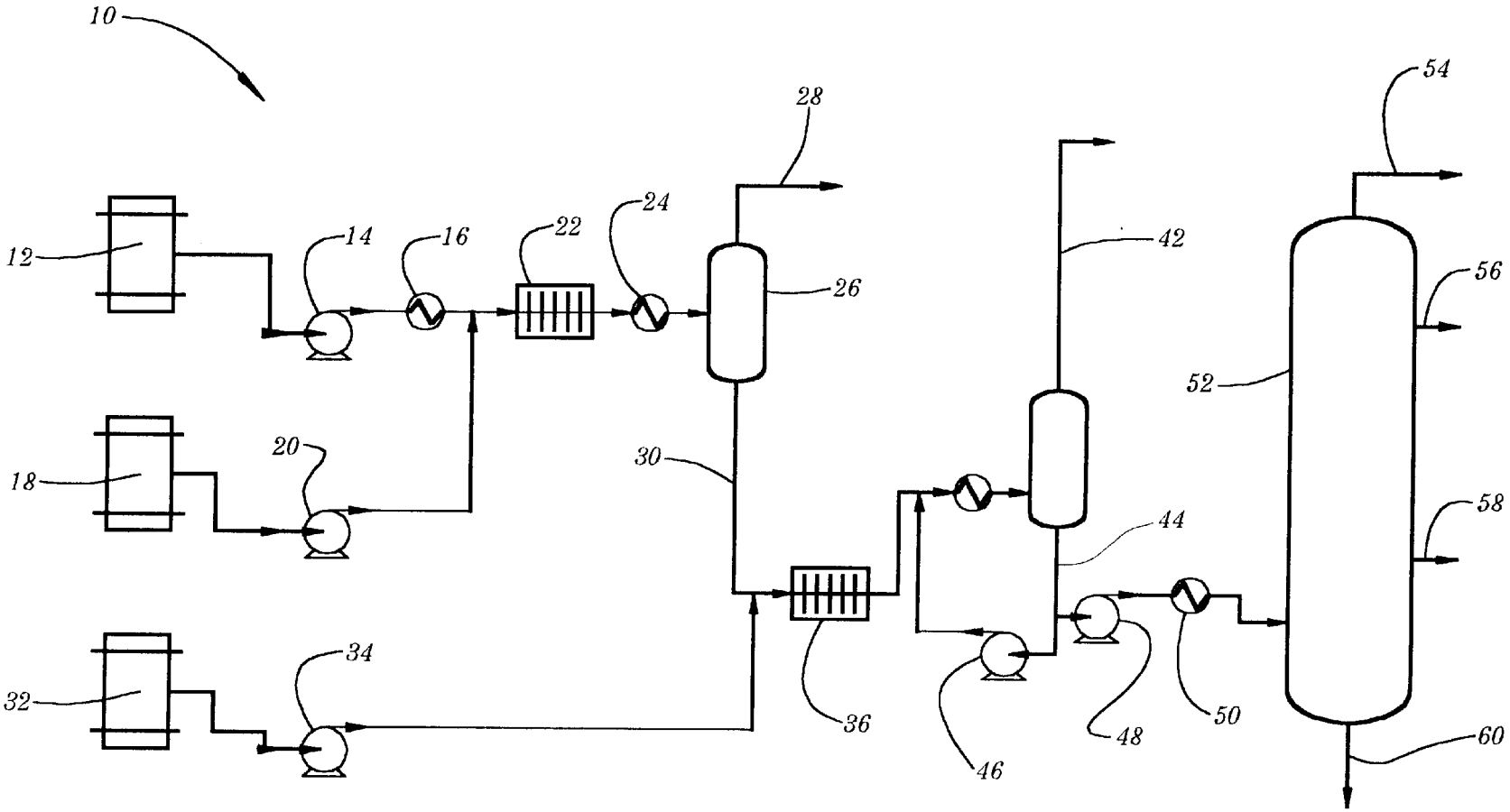
FIG. 1 is a diagrammatic illustration of a continuous flow apparatus catalyzed base treatment of used motor oil to remove contaminants therefrom.

The process of the present invention removes acidic compounds and color from used motor oil and other petroleum distillates. Additionally, the process removes or substitutes hydrocarbons containing heteroatoms, namely chlorine, boron, phosphorous, sulfur and nitrogen from the used motor oil. In removing these classes of compounds, the process uses inorganic or organic bases to catalyze various reactions and to neutralize organic acids. Further, the process is capable of removing polynuclear aromatic hydrocarbons from used motor oil. In removing these contaminants, the process makes use of a class of catalysts known as phase transfer catalysts, which are employed in the process to facilitate the transfer of inorganic or organic bases to the substrate in the used oil.

Examples of phase transfer catalysts that may be utilized in the process include: quaternary ammonium salts, polyol ethers, glycols and crown ethers. Through either the base catalysts or the neutralization reactions, undesirable components of the distillate oil are most often converted to forms that are easily removed from the used oil through distillation. Components that are not removed from the distillate are transposed to forms that may remain in the distillate with no adverse effect on the oil quality.

The invention is capable of operating in either a batch mode or a continuous flow mode. When the process is operated in the continuous flow mode, the catalyst and the base are injected into the used oil and passed through a heat exchanger to increase the temperature of the mixture. The mixture is then pumped through one or more static mixers to thoroughly mix the used oil with the catalyst and base. The mixture is then passed directly to the distillation apparatus, where additional mixing occurs and the catalyst and resulting oil are recovered separately. The catalyst is recovered in a form virtually free of hydrocarbon contamination. However, the catalyst contains small quantities of water, typically less than 1%, which is usable directly in the process.

Although other phase transfer catalysts can be used in the process, the use of ethylene glycol is preferred because, when ethylene glycol is used, the source of the catalyst can be used with glycol-based engine coolants. Thus, the catalyst can be acquired in raw form with little, if any, expenditure.

The relative amounts of base and phase transfer catalyst are predicated upon the level of contamination in the used oil. Thus, used oil containing greater than 500 parts-per-million total organic halogen would require a higher concentration of base and phase transfer catalyst to ensure that the dehalogenation reactions occur within a timeframe suitable for a continuous flow process.

A further benefit of the continuous flow mode is the fact that the only wastewater generated by the process is that which is originally present in the used oil and the small amount present in the base. No further water is required for the process. Additionally, all of the wastewater is recovered following distillation of the water and is therefore acceptable for direct discharge. If further treatment of the wastewater is required, the treatment scheme employed is minimal.

Flow Process

A process for removing contaminants from used motor oil 10 comprising a continuous flow process is shown in FIG. 1. In the process 10, the used oil from a source 12 is passed through a used oil feed pump 14 to a heater 16. At the same time, a 50% aqueous solution of sodium or potassium hydroxide from a source 18 is passed through a caustic feed pump 20 and into the used oil after it passes through and is heated to 70 tp 100° C. by a heater 16. The amount of sodium or potassium hydroxide added to the used oil is such that the concentration of base in the oil, on a dry weight basis, is between 0.5 and 5 weight percent. The used oil and the sodium or potassium hydroxide passes through a caustic mixer 22 and a heater 24, heating the mixture to 110 to 150° C. The used oil mixture is then passed into a water flash drum 26 where water and a small amount of naphtha are removed through flash outlet 28. The water flash drum is best operated at atmospheric pressure, thus allowing a higher feed temperature to promote the reactions. However, in principle the flash drum could operate under vacuum. The resultant dehydrated used oil mixture is then removed from the water flash drum 26 through a flash oil outlet 30.

Ethylene glycol from a source 32 is passed through a catalyst feed pump 34 and into the dehydrated used oil mixture. The amount of ethylene glycol that is added to the used oil is such that the concentration of glycol in the resulting mixture ranges from 1 to 10 weight percent of the used oil. The used oil feed pump 14, the caustic feed pump 20, and the catalyst feed pump 34 are each engaged at flow rates that provide the desired amounts of each material. The used oil mixture is passed through a catalyst mixer 36 and a heater 38, where it is heated to between about 275 and 350° C., and proceeds into a stage I evaporator 40. Heating the mixture beyond 350° C. is not recommended as temperatures above 350° C. result in excessive cracking of the used oil molecules. The stage I evaporator is typically operated under vacuum, with pressures ranging from about 150 to 300 millimeters. The catalyst and light hydrocarbons are removed through flash catalyst outlet 42 and the oil is removed through oil outlet 44. Part of the oil passes through a recycle pump 46 and back into the dehydrated used oil mixture after the catalyst mixer 36, but before the heater 38.

The remainder of the oil passes through a finishing pump 48 and a heater 50, where it is heated to from about 300 to 350° C., and into a stage II evaporator 52. The stage II evaporator operates under vacuum with pressures ranging from 5 to 0.05 millimeters. The stage II evaporator may be operated at lower temperatures and pressures, but this will result in a lower yield of the heavier base oil product. The stage II evaporator separates the oil into three fractions, the viscosities of which depend upon the used oil feed. The table below lists products from a typical used oil feed:

| Fraction | Color | Chlorine | Viscosity |
|---|---|---|---|
| light base oil | <0.5 | <5 ppm | 100 SUS |
| medium base oil | <1.0 | <5 ppm | 150 SUS |
| heavy base oil | <1.5 | <5 ppm | 300 SUS |
| still bottoms | n/a | n/a | n/a |

The light base oil is recovered through outlet 54, the medium base oil through outlet 56, the heavy base oil through outlet 58, and the still bottoms through outlet 60.

The still bottoms resulting from the simultaneous combination of the catalyzed base treatment with distillation yields important properties when combined with asphalt. In general, the still bottoms comprise a high value asphalt modifier, capable of extending the useful temperature range of most straight run asphalts. Specifically, the still bottoms impart favorable low temperature characteristics to asphalt, while maintaining the high temperature properties of the asphalt.

Although preferred embodiments of the invention have been illustrated in the accompanying drawings and described in the foregoing detailed description, it will be understood that the invention is not limited to the disclosed embodiments, but is capable of numerous rearrangements, modifications, and substitutions of parts and elements without departing from the spirit of the invention.

We claim:

1. A method of purifying used oil comprising the steps of:

placing used oil into a continuous flow apparatus;

contacting the used oil with a base introduced at such a rate as to maintain the base at about 1 weight % to about 10 weight % of the oil composition;

contacting the used oil with a phase transfer catalyst introduced at such a rate as to maintain the phase transfer catalyst at about 1 weight % to about 10 weight % of the oil composition;

heating the composition to a temperature between about 200° C. and about 275° C.;

mixing the composition;

separating the resultant mixture using a first distillation at a temperature of from about 200° C. to about 275° C. and a pressure of from about 100 torr to about 200 torr; and purifying the used oil using a second distillation at a temperature of from about 275° C. to about 300° C. and a pressure of from about 0.05 torr to about 0.20 torr.

2. The method as recited in claim 1 additionally comprising the step of:

heating the oil composition obtained from the first distillation to a temperature between about 200° C. and about 300° C.; and mixing the composition after the first distillation but before the second distillation.

3. A method of purifying used oil comprising the steps of:

placing used oil into a continuous flow apparatus;

contacting the used oil with a base selected from the group including sodium hydroxide and potassium hydroxide introduced at such a rate as to maintain the base at about 1 weight % to about 10 weight % of the oil composition;

contacting the used oil with ethylene glycol introduced at such a rate as to maintain the phase transfer catalyst at about 1 weight % to about 10 weight % of the oil composition;

heating the composition to a temperature between about 200° C. and about 275° C.;

mixing the composition;

separating the resultant mixture using a first distillation at a temperature of from about 200° C. to about 275° C. and a pressure of from about 100 torr to about 200 torr; and purifying the used oil using a second distillation at a temperature of from about 275° C. to about 350° C. and a pressure of from about 0.05 torr to about 0.20 torr.

* * * * *